US007374463B2

(12) United States Patent
Kuo

(10) Patent No.: US 7,374,463 B2
(45) Date of Patent: May 20, 2008

(54) ELECTRICAL CONNECTOR ASSEMBLY HAVING IMPROVED LOCKING MEMBER

(75) Inventor: Peter Kuo, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/646,838

(22) Filed: Dec. 27, 2006

(65) Prior Publication Data

US 2007/0149067 A1 Jun. 28, 2007

(51) Int. Cl.
*H01R 13/514* (2006.01)

(52) U.S. Cl. ..... 439/752; 439/607

(58) Field of Classification Search ..... 439/607, 439/352, 595

See application file for complete search history.

(56) References Cited

U.S. PATENT DOCUMENTS

| | | | | |
|---|---|---|---|---|
| 4,421,376 | A | 12/1983 | Cosmos et al. | |
| 5,411,421 | A * | 5/1995 | McCardell, Jr. | 439/879 |
| 5,522,740 | A * | 6/1996 | Plocek et al. | 439/752 |
| 6,171,136 | B1 | 1/2001 | Liu et al. | |
| 7,033,218 | B2 * | 4/2006 | Huang et al. | 439/607 |

* cited by examiner

*Primary Examiner*—Briggitte R. Hammond
(74) *Attorney, Agent, or Firm*—Wei Te Chung

(57) ABSTRACT

An electrical connector assembly (100) defines a housing defining a receiving space, a connector body (1) received in the receiving space and defining a plurality of contacts (12) received therein, a cable (2) defining a plurality of conductors (21) electrically attaching to corresponding contacts, and locking member (3) locking with the housing for attaching the connector body toward the housing reliably.

19 Claims, 6 Drawing Sheets

ELECTRICAL CONNECTOR ASSEMBLY HAVING IMPROVED LOCKING MEMBER

BACKGROUND OF THE INVENTION

1. Field of the Invention

The present invention relates generally to an electrical connector assembly, and more particularly to an electrical connector assembly for transmitting high-speed signals in an interconnection system.

2. Description of Related Arts

With the development of communication and computer technology, many electrical connectors with conductive elements are desired to construct a large number of signal transmitting paths between two electrical devices. Such electrical connectors are widely used in connecting systems of electrical devices and the like devices requiring data processing and communication.

For example, U.S. Pat. No. 6,171,136 B1 which issued to Northstar Farest on Jan. 9, 2001 shows a male type USB (Universal Serial Bus) connector comprising a connector body, a cable attached to the connector body, two symmetrical insulating shells fastened together and covered on the lateral side walls and rear side wall of the connector body and a part of the cable to secure the cable to the connector body, an insulating cap fastened to front portions of the connector body and the insulating shells, and two packing strips mounted between the backward coupling flange of the cap and the top, bottom side walls of the connector body.

However, such electrical connector in use needs to plug into or unplug from the complementary connector frequently, thereby causing two packing strips easy to escape from such electrical connector. In addition, in a vibrative circumstance, two packing strips are easy to loose and cannot interferentially mount such insulating cap with the connector body. Thus, a reliable connection between such electrical connector and the complementary connector is affected.

Hence, an electrical connector assembly having improved necklace cable is desired.

SUMMARY OF THE INVENTION

Accordingly, the object of the present invention is to provide an electrical connector assembly for assuring a reliable connection.

To achieve the above object, an electrical connector assembly in according with the present invention comprises a housing defining a receiving space, a connector body received in the receiving space, and defining a plurality of contacts received therein, a cable defining a plurality of conductors electrically attached to corresponding contacts, and locking member locking with the housing for attaching the connector body toward the housing reliably.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
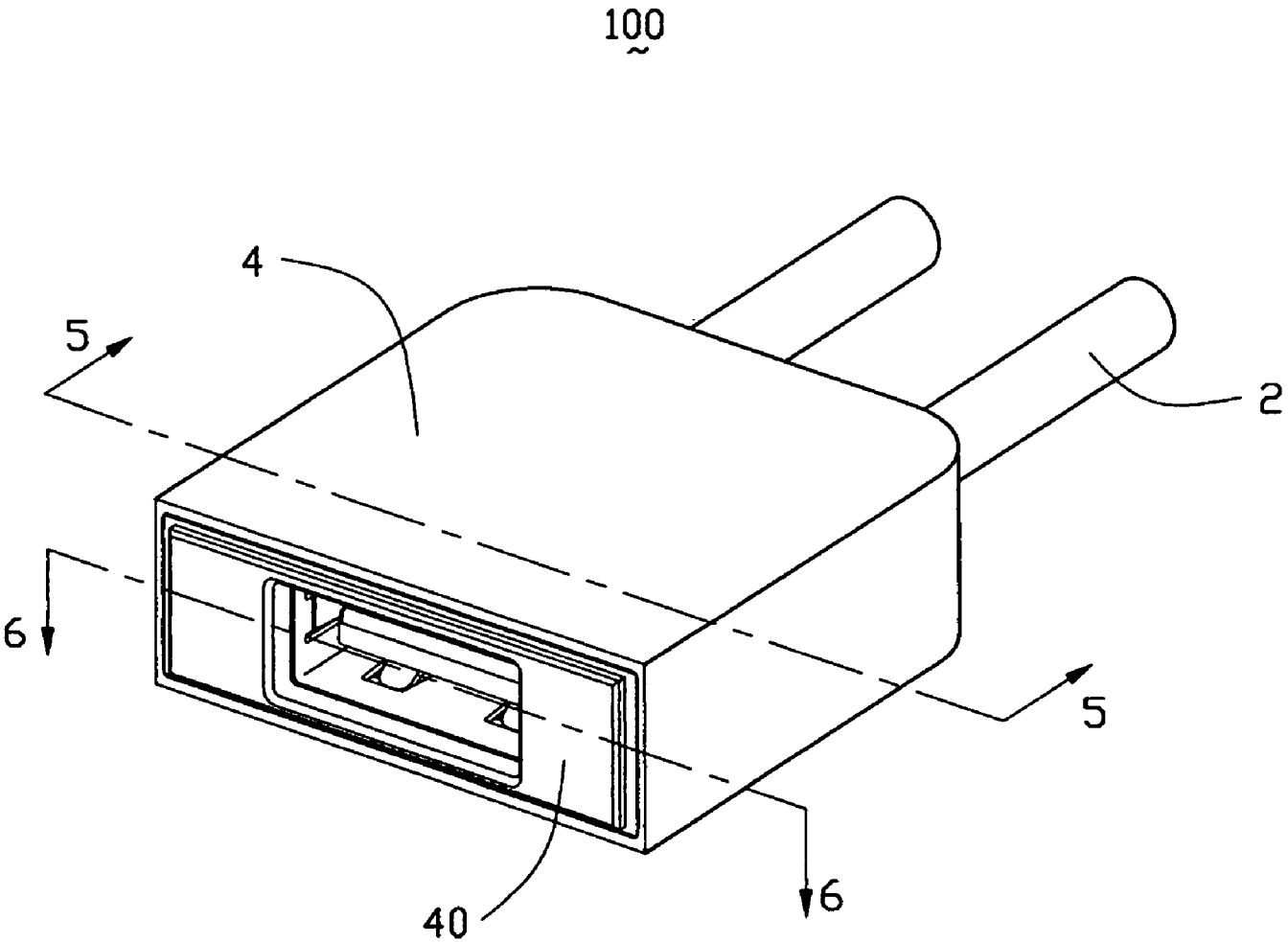
FIG. 1 is a perspective, assembled view of an electrical connector assembly in accordance with the present invention.
Figure 2:
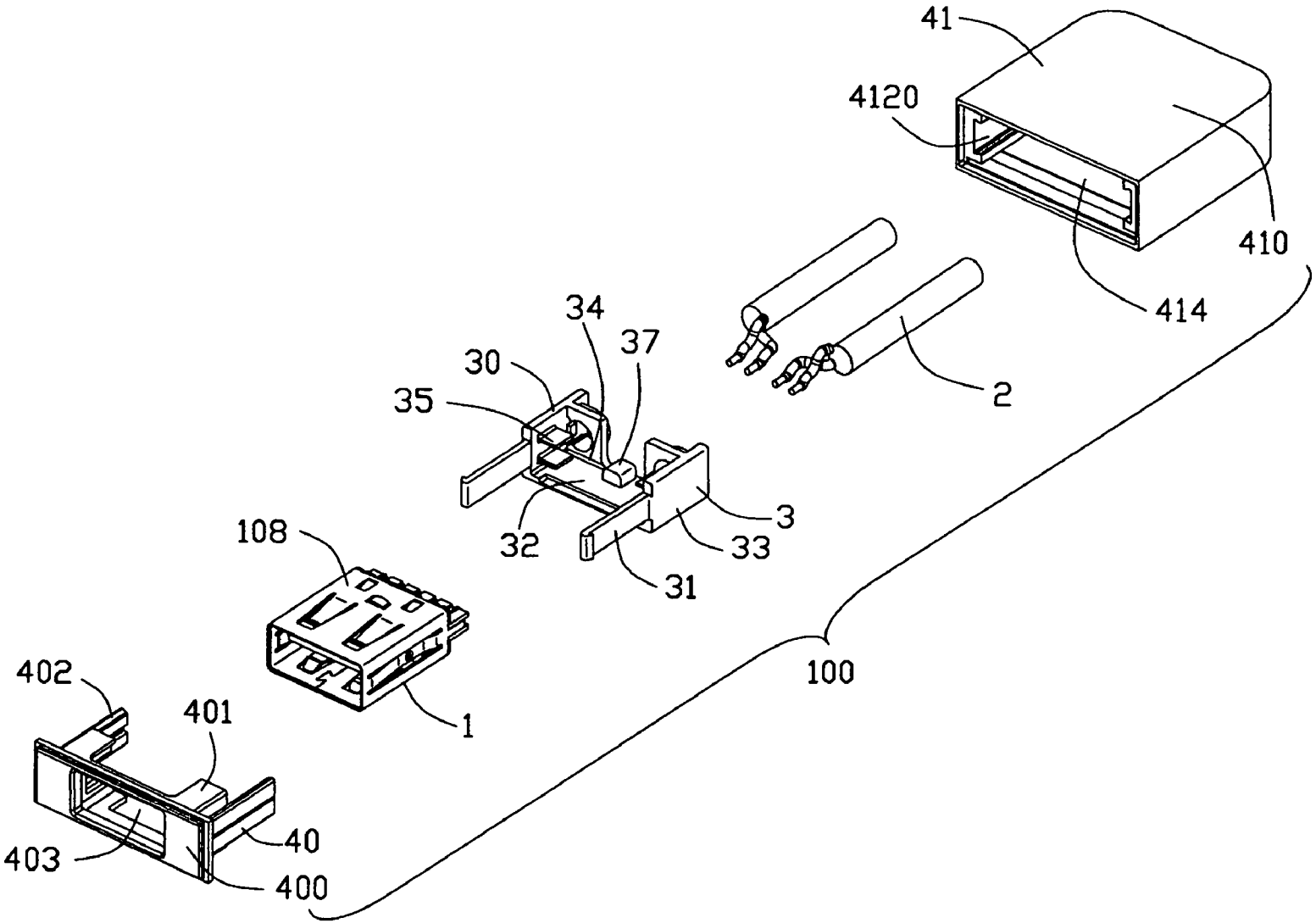
FIG. 2 is a partially perspective, exploded view of the electrical connector assembly of FIG. 1.
Figure 3:
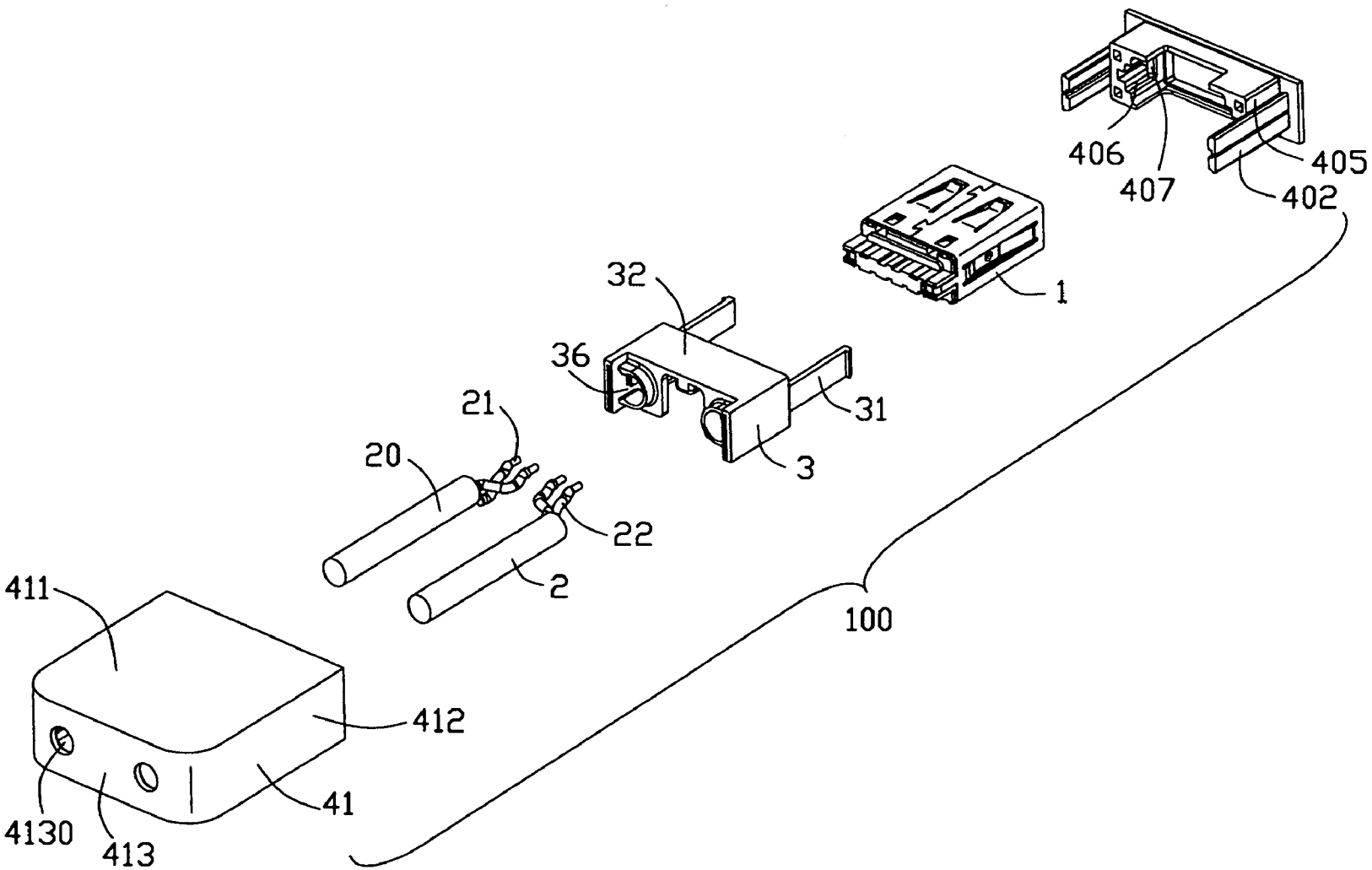
FIG. 3 is a view similar to FIG. 2, but taken from a different aspect.

Referring to FIGS. 1-3, an electrical connector assembly 100 in accordance with the present invention comprises a housing 4 defining a first housing piece 40 and a second housing piece 41 assembled to the first housing piece 40, a connector body 1 received in the housing 4, a cable 2 electrically attached to the connector body 1, and locking member 3 assembled to the first housing piece 40 for attaching the connector body 1 toward the first housing piece 40 reliably. The connector body 1 comprises a metal shell 10, an insulator 11 received in the metal shell 10, a plurality of contacts 12 received in the insulator 11 for electrically connecting with the cable 2, and a spacer 13 assembled to the insulator 11 for supporting the contacts 12.

Figure 4:
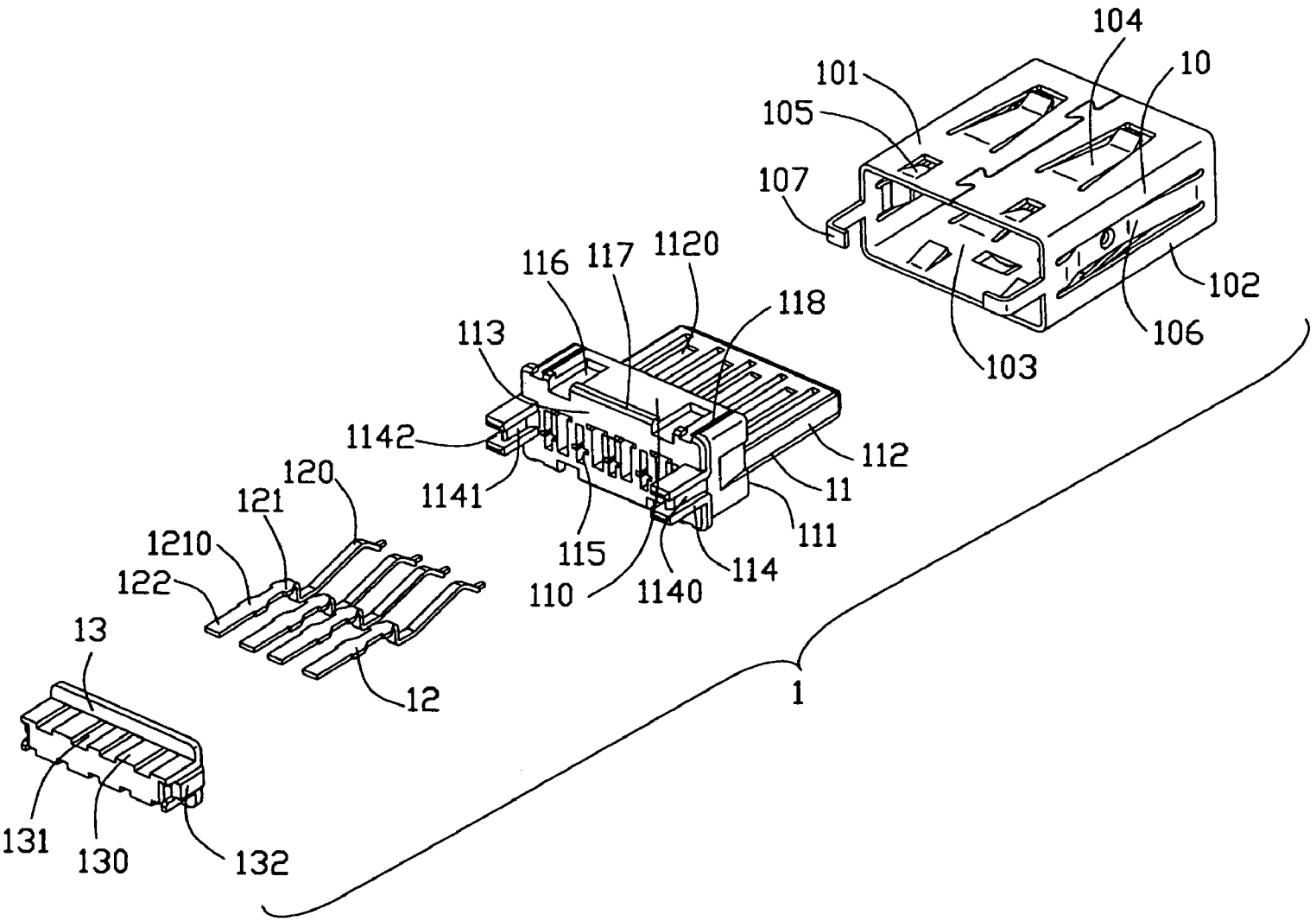
FIG. 4 is a perspective, exploded view of a connector body of the electrical connector assembly in accordance with the present invention.
Figure 5:
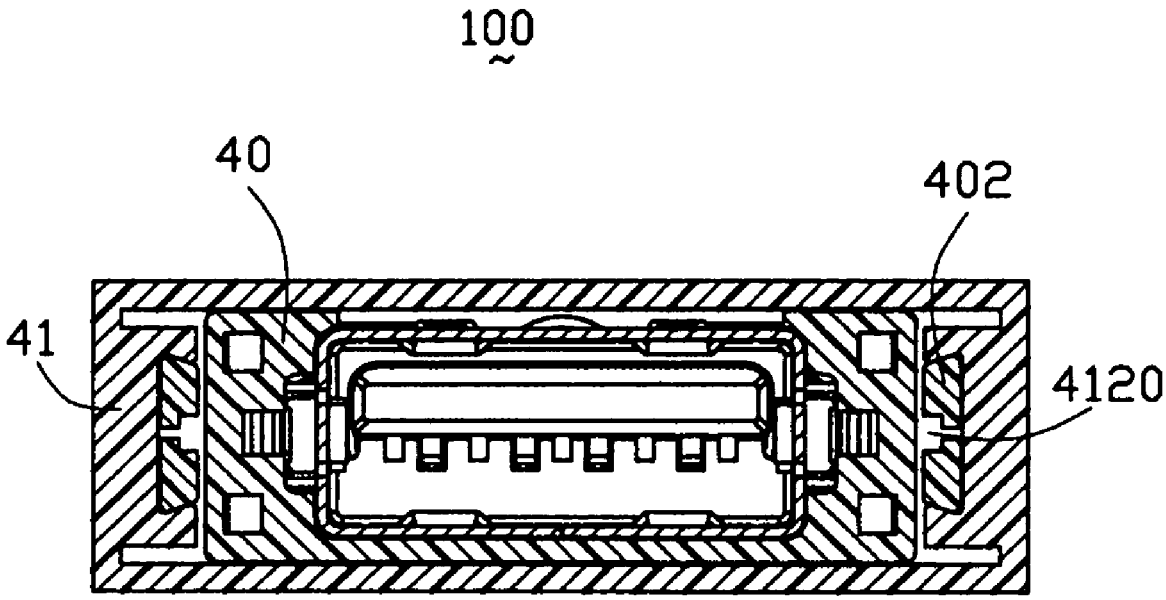
FIGS. 5-6 are cross sectional views of the electrical connector assembly of FIG. 1 taken along lines 5-5 and 6-6 of FIG. 1.

Referring to FIGS. 2-4, the metal shell 10 of the connector body 1 is generally stamped from a piece of metal or other conductive materials. The metal shell 10 is in an elongate frame shape for substantially shielding the insulator 11. The metal shell 10 comprises a first top wall 108, a first bottom wall 101 opposite to the first top wall 108, and a pair of first lateral walls 102 connecting with the first top and bottom walls 108, 101. These walls 100, 101, 102 together define a first receiving space 103 for receiving the insulator 11 therein. The first top and bottom walls 108, 101 respectively form a pair of first resilient pieces 104 protruding inwardly toward the receiving space 103 for electrically engaging with a corresponding element of complementary connector (not shown) when the electrical connector assembly 100 is assembled with the complementary connector, and a pair of second resilient pieces 105 aligning with corresponding first resilient pieces 104 in a rear-to-front direction. Each first lateral wall 102 forms a pair of third resilient pieces 106 protruding inwardly into the receiving space 103 for fixing the electrical connector assembly 100 with the complementary connector reliably in a direction perpendicular to the rear-to-front direction, and a pair of locking barbs 107 respectively extending rearwardly therefrom for locking with the insulator 11 and the spacer 13. Attentively, before an assembly process, the locking barb 107 is an I-shaped configuration. During the assembly process, the locking barb 107 will be bended from an I-shaped configuration into an L-shaped configuration for fastening the insulator 11 and the spacer 13 with the metal shell 10. Certainly, a person of ordinary skill in this art can easily replace the locking barb 107 with a locking barb of another shape, for example, of a fishhook-shaped.

Referring to FIGS. 2-4, the insulator 11 comprises a base 110, a tongue 112 extending forwardly from a front surface 111 of the base 110, and a pair of stretching portions 114 extending rearwardly from a rear surface 113 of the base 110 and formed adjacent to two lateral sides of the base 110. The base 110 further comprises a plurality of contact passageways 115 extending from the front surface 111 to the rear surface 113 thereof, for allowing the contacts 12 to be arranged in, a pair of locking slots 116 respectively recessed inwardly from top and bottom surfaces thereof and formed adjacent to the rear surface 113 for allowing the second resilient pieces 105 engaging with, a pair of transversally extending baffles 117 respectively disposed on the rear edges of top and bottom surfaces thereof, and a pair of longitudinally extending ribs 118 disposed on two lateral edges of top and bottom surfaces thereof for interferentially engaging with corresponding inner surfaces of the metal shell 10. The tongue 112 with a flat-shape configuration, comprises a plurality of contact slots 1120 aligning with the contact passageways 115 for respectively allowing the contacts 12 positioned therein. Each stretching portion 114 comprises a restrictive slit 1140 recessed inwardly from the outer wall thereof for guiding the slide movement of the locking barb 107, a guiding slit 1141 disposed in the inner wall thereof for guiding the spacer 13 to insert in, and a transverse locking slit 1142 communicating with the restrictive slit 1140 and the guiding slit 1141 and provided for allowing the locking barb 107 to lock therewith.

Referring to FIG. 4, each contact 12 comprises a mating end 120 for electrically mating with corresponding contact of the complementary connector, a tail end 122 for electrically connecting to the cable 2 and a connecting portion 121 connecting with the mating end 120 and the tail end 122. Each connecting portion 121 defines a plurality of stings 1210 disposed on two sides thereof for providing a retention function.

Referring to FIGS. 2-4, the spacer 13 with a T-shaped structure comprises a base 130. The base 130 defines a plurality of contact channels 131 recessed from one surface thereof and respectively communicating to corresponding contact passageways 115 for allowing corresponding tail ends 122 of the contacts 12 received therein, and a pair of guiding members 132 disposed at two sides thereof and respectively received in corresponding guiding slits 1141 for providing a reliable connection therebetween.

Referring to FIGS. 2-4, the cable 2 comprises a plurality of wires 20. Each wire 20 comprises a plurality of conductors 21 for transmitting signal and an insulative jacket 22 surrounding the conductors 21 for providing sheath.

Referring to FIGS. 2-4, the locking member 3 comprises a body portion 30 and a pair of locking arms 31 extending forwardly from two lateral sides of the body portion 30. The body portion 30 with an U-shape cross sectional view comprises a second bottom wall 32 and a pair of second lateral walls 33. The second bottom wall 32 and the lateral walls 33 together define a second receiving space 34 for partially enclosing the connector body 1. Each second lateral wall 33 comprises a restrictive piece 35 flatly extending into the second receiving space 34 and a cable restrictive channel 36 spaced with the restrictive piece 35 along the rear-to-front direction and for allowing the cable 2 extending therethrough. The restrictive piece 35 in this embodiment is a pair of spaced pieces for positing the stretching portions 114 of the insulator 11 therebetween. However, a person with ordinary skill of this art can replace the spaced pieces with another structure. Each second bottom wall 32 comprises a bar 37 close to a rear surface thereof and extending into the second receiving space 34 for abutting against the spacer 13 of the connector body 1 and preventing the connector body 1 from moving rearwardly excessively.

Figure 6:
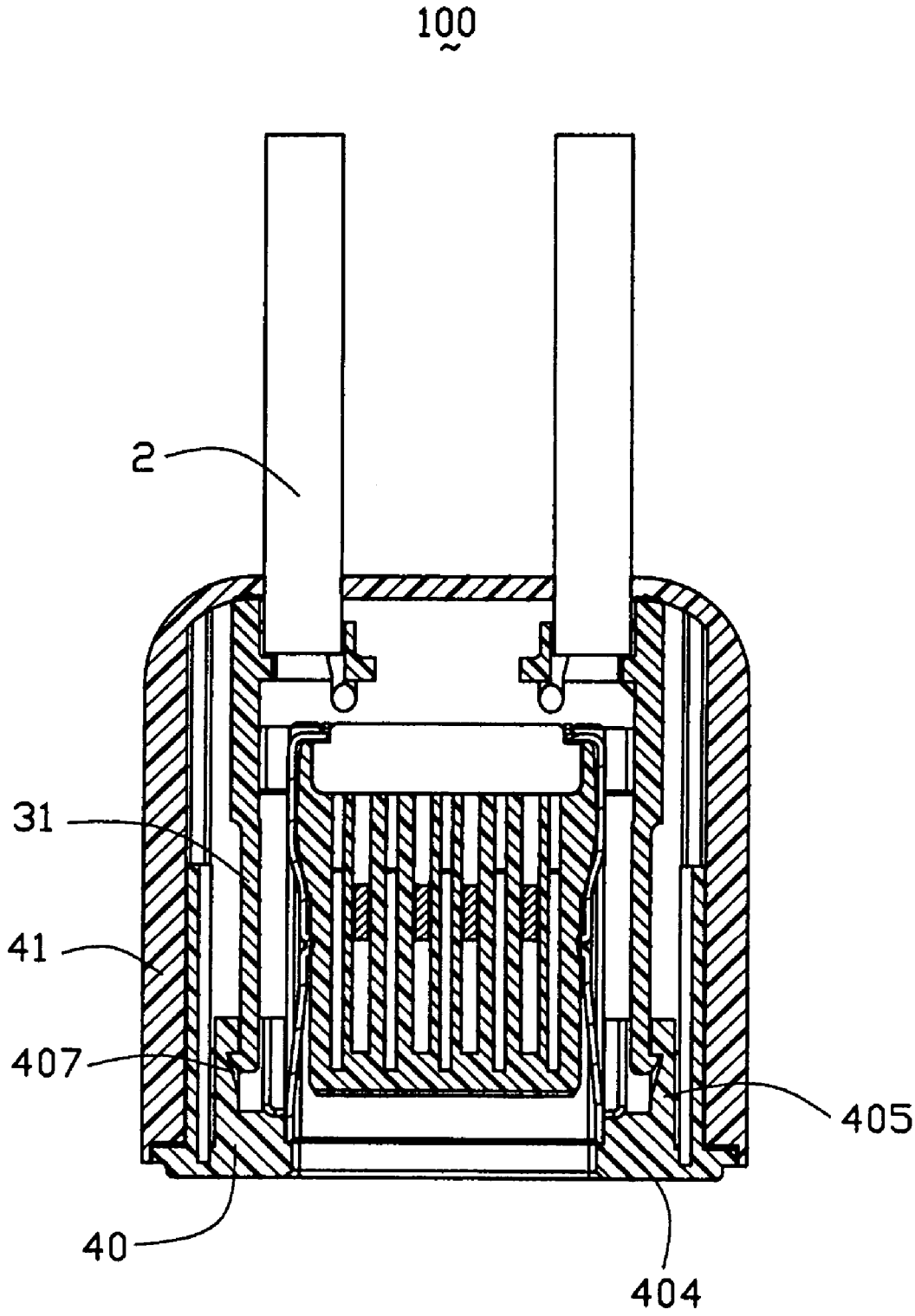

Referring to FIGS. 2-3 in conjunction with FIG. 6, the first housing piece 40 comprises a front mating interface 400, a frame 401 extending rearwardly from the mating interface 400, and a pair of locking pieces 402 extending rearwardly from the mating interface 400 and formed at two lateral sides of the frame 401. The mating interface 400 is hollow in the midst thereof and forms a mating opening 403 for mating with the complementary connector. The mating interface 400 together with the frame 401 forms a restrictive portion 404 for preventing the connector body 1 being inserted excessively. The frame 401 forms a pair of third lateral walls 405 opposite to each other. Each third lateral wall 405 comprises a guiding groove 406 recessed from an inner surface thereof and extending along the rear-to-front direction for guiding corresponding locking arm 31 to insert in, and a locking cavity 407 formed at a distal end of the guiding groove 406 for allowing the locking arm 31 to lock with. Each locking piece 402 is a pair of spaced wedge-shaped pieces in this embodiment, other structures, such as a triangular piece, a trapeziform piece, are provided easily in other embodiment by a person of ordinary skill in this art.

Referring to FIG. 2 in conjunction with FIG. 6, the second housing piece 41 comprises a fourth top wall 410, a fourth bottom wall 411 opposite to the fourth top wall 410, a pair of fourth lateral walls 412, and a fourth rear wall 413. These walls together define a fourth receiving space 414 for receiving the connector body 1 and the locking member 3. Each fourth lateral wall 412 comprises a restrictive slot 4120 aligned with the locking piece 402. In this embodiment, the locking pieces 402 are respectively inserted in and restrictedly received in the restrictive slots 4120 of wedge-shaped structure. According to a structure of the locking pieces 402, a person with ordinary skill in this art can design corresponding slots to mate with the locking pieces 402. Each fourth rear wall 413 forms a pair of cable channels 4130.

In assembly, referring to FIGS. 1-6, the contacts 12 are firstly and respectively inserted into corresponding contact receiving passageways 115 of the insulator 11 until the mating ends 120 are respectively received in corresponding contact slots 1120 of the tongue 112, with the stings 1210 of the connecting portion 121 interferentially abutting with the inner walls of the contact receiving passageways 115 for provided a reliable orientation therebetween. Then, the spacer 13 is pushed and engaged with the insulator 11, with the tail ends 122 of the contacts 12 received in corresponding contact channels 131 of the spacer 13 and the guiding members 132 respectively received in corresponding guiding slots 1141 of the insulator 11. Obviously, the spacer 13 seals the contact receiving passageways 115 and efficiently prevents exterior material from entering into contact receiving passageways 115 and influencing the electrical connection between the electrical connector assembly 100 and the complementary connector.

Subsequently, above assembly is pushed and received into the metal shell 10, with the base 110 and the tongue 112 are together received in the first receiving space 103 until the baffles 117 of the insulator 11 abutting against rear edge of the metal shell 10 for avoiding an excessive insertion of the above assembly. In addition, during insertion process, the second resilient pieces 105 of the metal shell 10 respectively engage with corresponding locking slots 116 for preventing the insulator 11 from moving rearwardly, the ribs 118 of the insulator 11 are tightly abutting against the inner surfaces of the metal shell 10 for providing a reliable connection therebetween. The locking barbs 107 respectively slide along corresponding restrictive slits 1140 of the insulator 11, and bent inwardly to lock with the locking slits 1142 of the insulator 11 and the rear ends of the guiding members 132 of the spacer 13 for fastening these three elements together. Obviously, the first resilient piece 104 and the third resilient piece 106 can abut against the complementary parts of the complementary connector from different directions for providing a reliable connection between the cable connector assembly 100 and the complementary connector.

Then, the wires 20 of the cable 2 are inserted into the cable restrictive channels 36, and respectively soldered to the tail ends 122 of the contacts 12.

Then, forwardly sliding the locking member 3 over the cable 2 until the restrictive pieces 35 abut against the rear surface 113 of the insulator 11, with the stretching portions 114 of the insulator 11 sandwiched between the two spaced pieces of the restrictive pieces 35, the connector body 1 partially received in the second receiving space 34, and the spacer 13 abutting against the bar 37.

Later, inserting the above assembly into the first housing piece 40. The connector body 1 is inserted into the frame 401 until the metal shell 10 abutting against the restrictive portion 404 for preventing the connector body 1 being inserted excessively. At the same time, the locking members 3 respectively slide along the guiding grooves 406 of the third lateral walls 405 until the locking arms 31 respectively lock with corresponding locking cavities 407, thereby attaching the connector body 1 to the first housing piece 40 reliably.

Lastly, attaching the second housing piece 41 with the first housing piece 40 along the rear-to-front direction. During this process, the connector body 1, the locking member 3 and the frame 401 of the first housing piece 40 are received in the fourth receiving space 414 of the second housing piece 41, the cable 2 extends through the cable channels 4130. Noticeably, the restrictive slots 4120 of the second housing pieces 41 can guide an insertion of the locking pieces 402 of the first housing piece 40. In this embodiment, each locking piece 402 is a pair of wedge-shaped pieces spaced each other. When the spaced wedge-shaped pieces are inserted into the restrictive slots 4120 of wedge-shaped, due to that a dimension of locking piece 402 along a vertical direction is appreciably larger than the restrictive slot 4120 and the pair of wedge-shaped pieces define an interspace therebetween, the spaced wedge-shaped pieces will move toward each other, and lock with the restrictive slots 1420 reliably by a restorative force of the spaced wedge-shaped pieces, thereby attaching the first housing piece 40 to the second housing piece 41 reliably. Here, the looking pieces 402 of the first housing piece 40, and the restrictive slots 4120 of the second housing piece 41, together function as a locking mechanism. Obviously, a looking piece similar to the looking pieces 402 and formed on the second housing piece 41, and a restrictive slot similar to the restrictive slots 4120 and formed on the first housing piece 40 analogically designed by the person with ordinary skill also can function as the locking mechanism and therefore, achieve a reliable assembly between the first and second housing pieces 40, 41.

In addition, during a conventional process to mold the second housing piece 41, first, injecting the melted plastic into a mold which comprises an exterior mold and an interior mold, then, cooling the melted plastic located between the interior mold and the exterior mold, later, taking away the exterior mold and the interior mold. Because the melted plastic needs to flow into the mold through a plurality of injecting inlets, after cooling, the redundant plastic will form some dots on the surface of the second housing piece 41. Now, these redundant dots inevitably influence the tidiness of the second housing piece 41. According to one aspect of present invention, the process to mold the second housing piece 41 is novel and can not raise above problem. The melted plastic is injected into the mold through only two injecting inlets, after cooling, the redundant plastic will form only two dots on the surface of the second housing piece 41 and aligned with two injecting inlets. At last, the fourth rear wall 413 of the second housing piece 41 with two dots disposed thereon must be punched and forms a pair of cable channels 4130 allowing the cable to extend through.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector assembly, comprising:

a housing defining a receiving space;

a connector body entirely received in the receiving space, and defining a plurality of contacts received therein;

a cable defining a plurality of conductors electrically attaching to corresponding contacts; and locking member entirely received in the receiving space of the housing and assembled to the connector body, the locking member locking with the housing to secure the connector body toward the housing reliably; and wherein the locking member comprises a restrictive piece extending from one of the lateral wall and the bottom wall for arranging the connector body.

2. The electrical connector assembly as described in claim 1, wherein the locking member comprises a body portion and a locking arm extending from the body portion, the housing comprises a locking cavity, the locking arm locks with the locking cavity.

3. The electrical connector assembly as described in claim 1, wherein the locking member comprises a cable channel extending from one of the lateral wall and the bottom wall for allowing the cable extending through and attaching with corresponding contact.

4. The electrical connector assembly as described in claim 1, wherein the locking member comprises a bar extending from one of the lateral wall and the bottom wall for preventing the connector body moving rearwardly.

5. The electrical connector assembly as described in claim 1, wherein the housing comprises a first housing piece and a second housing piece mainly received in the first housing piece and with a mating interface exposed outside.

6. The electrical connector assembly as described in claim 1, wherein the locking member comprises a restrictive piece extending from one of the lateral wall and the bottom wall for arranging the connector body.

7. The electrical connector assembly as described in claim 6, wherein the connector body comprises a stretching portion, and wherein the restrictive piece of the locking member comprises two spaced pieces sandwiched the stretching portion therebetween.

8. The electrical connector assembly as described in claim 1, wherein the housing comprises a first housing piece and a second housing piece attached to the first housing piece in a rear-to-front direction.

9. The electrical connector assembly as described in claim 8, wherein the first housing piece comprises a frame for limiting the connector body and a pair of locking pieces arranged at two sides of the frame locking with the second housing.

10. The electrical connector assembly as described in claim 9, wherein the frame comprises a guiding groove for providing a guidance of an insertion of the locking member.

11. The electrical connector assembly as described in claim 10, wherein the frame comprises a locking cavity in one end of the guiding groove, the locking member comprises a locking arm locking with the locking cavity.

12. The electrical connector assembly as described in claim 8, wherein the first housing piece and the second housing piece together define the receiving space, the connector body and the locking member are both received in the receiving space.

13. The electrical connector assembly as described in claim 12, wherein the first housing piece and the second housing piece together form a locking mechanism for attaching the first housing piece with the second housing piece reliably.

14. The electrical connector assembly as described in claim 13, wherein the locking mechanism is formed by a locking piece of the first housing piece and a restrictive slot of the second housing piece.

15. The electrical connector assembly as described in claim 14, wherein the locking piece is a pair of spaced pieces, the spaced pieces are restrictively received in the restrictive slot with the spaced pieces being pushed and closed to each other, thereby achieving a reliable connection between the first housing piece and the second housing piece by a restorative force of the spaced pieces.

16. The electrical connector assembly as described in claim 15, wherein the locking piece is a wedge-shape piece, and wherein the restrictive slot is a wedge-shape slot, the locking piece is restrictively received in the restrictive slot.

17. An electrical connector assembly, comprising:

a housing defining a rear-to-front direction opposite to a mating direction of the electrical connector assembly, and defining a first housing piece and a second housing piece assembled to the first housing piece in the rear-to-front direction, the first housing and the second housing together defining a receiving space and a front mating opening communicating with the receiving space along said mating direction;

a connector body received in the receiving space behind the front mating opening, and comprising a metal shell, an insulator received in the metal shell, and a plurality of contacts received in the insulator;

a cable comprising a plurality of conductors attaching to corresponding contacts; and locking member attached with the connector body and locking with the first housing in the rear-to-front direction for directing the connector body toward the first housing piece reliably.

18. The electrical connector assembly as described in claim 17, wherein the locking member comprises a body portion and a locking arm extending from the body portion in the rear-to-front direction, the first housing piece comprises a locking cavity, the locking arm locks with the locking cavity.

19. An electrical cable connector comprising:

an insulative front housing defining a front opening;

a rear locking member fastening to the housing and cooperating with said housing to define a receiving space;

an electrical connector received in said receiving space, said connector including an insulator enclosed by a metallic shell and defining a mating port along a front-to-back direction;

a plurality of contacts disposed in the insulator and exposed in the mating port;

a plurality of wires mechanically and electrically connected to the corresponding contacts; wherein the connector is snugly confined between the housing and the locking member along front-to-rear direction.

* * * * *